United States Patent [19]

Lamborn

[11] 4,261,366

[45] Apr. 14, 1981

[54] BRASSIERE CONSTRUCTION

[76] Inventor: Sally Lamborn, Stedman Rd., Lee Center, N.Y. 13363

[21] Appl. No.: 106,931

[22] Filed: Dec. 26, 1979

[51] Int. Cl.[3] ..... A41C 3/10

[52] U.S. Cl. ..... 128/478; 128/479; 128/482

[58] Field of Search ..... 128/482, 478, 479, 461, 128/472

[56] References Cited

U.S. PATENT DOCUMENTS

| | | | |
|---|---|---|---|
| 3,701,168 | 10/1972 | Balow | 128/478 |
| 3,717,671 | 6/1970 | Freedman | 128/478 |
| 3,950,792 | 4/1976 | Williams | 128/478 |

*Primary Examiner*—Doris L. Troutman

*Attorney, Agent, or Firm*—Bruns & Jenney

[57] ABSTRACT

An improved brassiere for a person who has had a mastectomy operation. The brassiere may comprise a conventional garment in which at least one of the bust cups is adapted to receive and hold an artificial bust form. The cup in which the bust form is received is provided with an inside liner member that coacts with the cup to form a pocket enclosure for the form. The liner member is a unitary piece of bias cut soft material that extends continuously from a point adjacent the center of the brassiere, across the bust form receiving cup and out to the end of the adjacent side strap. The liner member is dimensioned so that its peripheral edges extend beyond the peripheral edges of the cup and strap thereby preventing the edges of the latter from contacting the wearer.

7 Claims, 5 Drawing Figures

BRASSIERE CONSTRUCTION

BACKGROUND OF THE INVENTION

This invention relates generally to female undergarments, and has particular reference to an improved brassiere for a woman who has had a mastectomy operation.

Through the years a considerable amount of prior art has been developed in the field of undergarments, and particularly brassieres, for women who have had one or both breasts removed by surgery. In most instances, it has been the objective of the designers to provide a garment that offers comfort and peace of mind to the wearer and, at the same time, gives a natural appearance under all conditions of activity.

Unfortunately, some of the prior art brassieres have been too uncomfortable to wear after surgery because of wires, relatively stiff seams or the like. Others, while more comfortable, have not felt natural to the wearer and sometimes have not presented a natural appearance. Another problem that has been encountered is that some mastectomy brassieres tend to slide or shift position unnaturally during activities such as sports or dancing. Finally, some mastectomy brassieres that have a number of very good features are so expensively constructed that the average woman cannot afford to buy them.

Some examples of the prior art garments referred to above, developed in a preliminary search, are U.S. Pat. Nos.:

| | |
|---|---|
| 3,301,260 | 3,619,819 |
| 3,304,558 | 3,701,168 |
| 3,348,241 | 3,950,792 |
| 3,517,671 | 4,023,575 |
| 3,568,681 | 4,071,914 |

Of the above listed patents, Freedman U.S. Pat. No. 3,517,671 and Nixon U.S. Pat. No. 4,023,575 are believed to be the closest to the present invention. The Freedman patent is directed to a novel pocket structure for receiving an artificial bust form in a brassiere that is otherwise conventional. The pocket includes a securing flap that is located and arranged so that the flap and adjacent brassiere structure would be likely to cause discomfort to sensitive tissues following surgery.

The Nixon patent is directed to a prosthesis or bust form for use in a conventional brassiere. The prosthesis directly contacts the wearer and unlike the present invention the brassiere does not include a pocket enclosure in which the prosthesis is received.

As will be described in more detail hereinafter, the present invention also contemplates an artificial bust form wherein the filling is a granular material. The two Mann Pat. Nos. 3,304,558 and 3,619,819 listed above, both disclose bust forms in which the filling includes granular material in addition to other materials.

SUMMARY OF THE INVENTION

The invention disclosed herein provides an improved brassiere and artificial bust form for a person who has had a mastectomy operation. The brassiere may comprise a conventional garment in which at least one of the bust cups is adapted to receive and hold the bust form. The cup in which the bust form is received is provided with an inside liner member that coacts with the cup to form a pocket enclosure for the form.

The liner member directly contacts the wearer and is a unitary piece of bias cut, soft fabric that extends continuously from a point adjacent the center of the brassiere, across the bust form receiving cup and out to the end of its adjacent side strap. The liner member is dimensioned so that its peripheral edges extend beyond the peripheral edges of the cup and strap thereby preventing the edges of the latter from contacting the wearer.

DESCRIPTION OF THE PREFERRED EMBODIMENT

Figure 1:
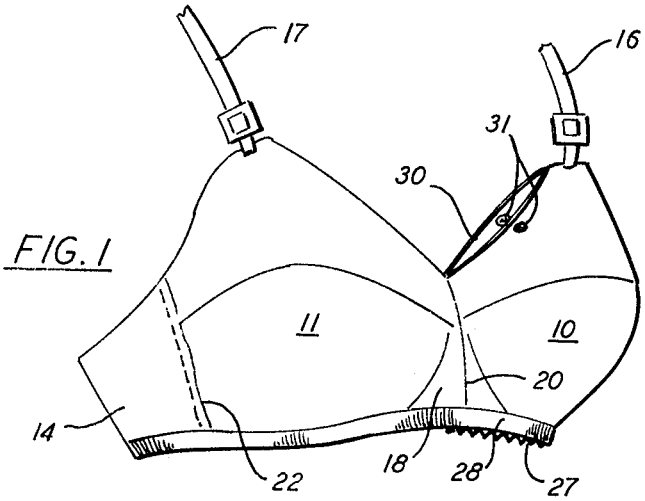
FIG. 1 is a front perspective view of a brassiere embodying the present invention.

Having reference now to the drawings, the brassiere of the invention is essentially comprised of left and right bust cups 10 and 11, side straps 13 and 14, and shoulder straps 16 and 17. The inner sides of the cups are connected together as by a center panel 18 having a centerline seam 20, FIGS. 1 and 2, this construction being substantially conventional. Side strap 13 is connected at its inner end to the outer side 21 of cup 10, while side strap 14 is connected at its inner end to the outer side 22 of cup 11.

The side straps 13,14 are adapted to encircle the body of the wearer and are provided with suitable coacting means (now shown) at their outer ends for securing the latter together when the brassiere is worn. The shoulder straps 16 and 17 extend from high points on their respective cups 10 and 11 to the side straps 13,14 in a manner well known in the art.

Figure 4:
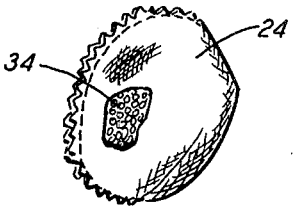
FIG. 4 is a front perspective view of an artificial bust form embodying the invention.

In accord with the invention, the brassiere is adapted for use by a person who has had a mastectomy, or surgery resulting in the removal of one or both of the natural breasts. If the left breast, for example, has been removed, means are provided so that the left cup 10 can receive and hold an artificial bust form or prosthesis 24, FIG. 4, in a natural and comfortable manner. To this end, the entire left side of the brassiere is covered on the inside thereof with an inside liner member 25 that coacts with the bust cup 10 to form a pocket 26, FIG. 3, for the bust form 24.

Figure 2:
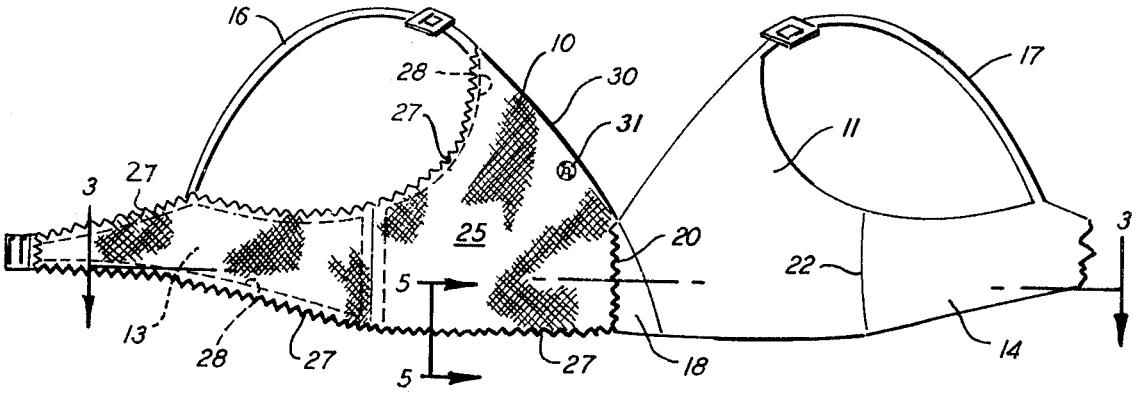
FIG. 2 is a fragmentary rear elevation of the brassiere.
Figure 5:
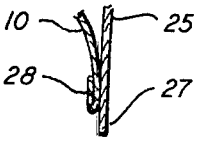
FIG. 5 is an enlarged, fragmentary sectional view taken on line 5—5 of FIG. 2 to illustrate a detail of the construction.

The liner member 25 directly contacts the wearer and is a single piece of very soft fabric that is cut on the bias as indicated in FIG. 2 to provide stretchability. Member 25 extends continuously from a point adjacent the centerline seam 20 to the outer end of side strap 13 so that no part of the left side of the brassiere itself engages sensitive areas of the wearer. To ensure that only the soft liner member contacts the wearer, its peripheral edges 27 extend beyond the peripheral seams 28 of the brassiere along the upper and lower edges of the cup 10 and side strap 13. This is clearly shown in the detail of FIG. 5 and prevents any roughness there may be in the seams of the brassiere from coming into contact with the wearer.

The bust form pocket 26 is formed by stitching or adhesively securing the liner member 25 to the lower edge of cup 10, its outer side 21, FIG. 2, and the outside portion of its upper edge, the latter extending from the front end of shoulder strap 16 downwardly to the cup outer side 21. The liner member is not secured to the inside portion 30 of the upper edge of the cup, i.e. from the front end of shoulder strap 16 down to the upper end of the centerline seam 20, to provide an opening through which the bust form 24 can be inserted into or removed from the pocket 26. Fastening means such as a snap fastener 31 may be provided to close the pocket opening when the bust form is positioned therein.

Figure 3:
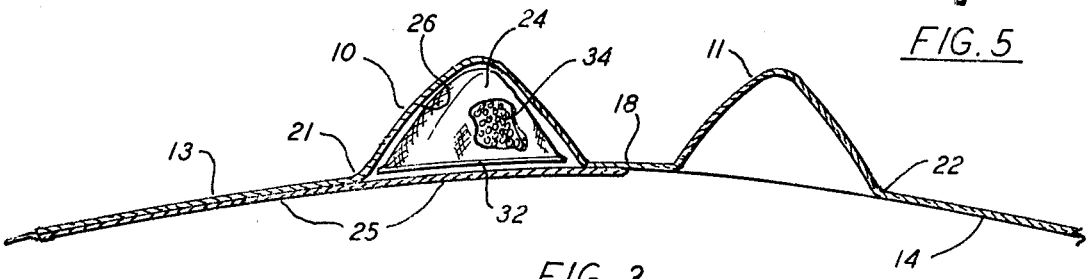
FIG. 3 is a horizontal sectional view taken on line 3—3 of FIG. 2.

The generally conical bust form 24 has a back or inside panel 32, FIG. 3, of a soft material such as flannel. It is contemplated that the form will be filled with a suitable granular material 34, FIGS. 3 and 4, because it has been found this imparts the most natural feel and appearance to the form.

With the brassiere construction described, a user can purchase a conventional brassiere or take one she already has and adapt it for use as a mastectomy brassiere by incorporating a pocket forming liner member 25 in the manner described. Obviously, the brassiere can also be initially manufactured and sold as a mastectomy brassiere, the construction being economical as well as highly satisfactory to the user.

From the foregoing description, it will be apparent that the invention provides a very advantageous yet relatively simple mastectomy brassiere construction. As will be understood by those familiar with the art, the invention may be embodied in other specific forms without departing from the spirit or essential characteristics thereof.

I claim:

1. A mastectomy brassiere having a pair of bust cups connected to each other adjacent the center of the brassiere, a pair of side straps respectively connected to the cups and adapted to encircle the body of the wearer, at least one of the cups being adapted to have an artificial bust form positioned therein, and an inside liner member that coacts with said one cup to form a pocket enclosure for the bust form, the liner member being a unitary piece of soft material that extends continuously from a point adjacent the center of the brassiere across said one cup and over its respective side strap to the outer end thereof, the liner member being dimensioned so that it extends beyond the peripheral edges of the cup and longitudinal edges of the strap whereby said edges are prevented from contacting the wearer.

2. A mastectomy brassiere as defined in claim 1 wherein the liner member is fabric and is cut on the bias, the liner member being secured to said one cup and side strap so that its threads are oriented so as to be on the bias relative to the longitudinal axis of the brassiere.

3. A mastectomy brassiere as defined in claim 1 wherein said liner member is secured to said one cup at the peripheral edges thereof except along the inside portion of the upper edge, the unsecured portion permitting an artificial bust form to be inserted into and removed from said one cup.

4. A mastectomy brassiere as defined in claim 1 together with an artificial bust form comprising a generally conical enclosure and a filling for the enclosure of granular material.

5. In a brassiere having a pair of bust cups, means connecting the inner sides of the two cups together, and a pair of side straps respectively connected at their inner ends to the outer sides of the cups, the outer ends of the straps having coacting fastening means whereby the straps can be connected together after encircling the body of the wearer, the improvement comprising means to permit the brassiere to be used with an artificial bust form by a person who has had a mastectomy operation, said means including an inside liner member that coacts with one of the bust cups to form a pocket enclosure for the artificial bust form, the liner member being a unitary piece of bias cut soft material that extends continuously from the means connecting the inner sides of the bust cups across said one cup and over its respective side strap to the outer end thereof, the liner member being dimensioned so that it extends beyond the peripheral edges of the cup and longitudinal edges of the strap whereby said edges are prevented from contacting the wearer.

6. A mastectomy brassiere as defined in claim 5 wherein said liner member is secured to said one cup at the peripheral edges thereof except along the inside portion of the upper edge, the unsecured portion permitting an artificial bust form to be inserted into and removed from said one cup.

7. A mastectomy brassiere as defined in claim 5 together with an artificial bust form comprising a generally conical enclosure and a filling for the enclosure of granular material.

* * * * *